US011843157B2

(12) United States Patent
Uemichi

(10) Patent No.: US 11,843,157 B2
(45) Date of Patent: Dec. 12, 2023

(54) MODE CONVERTER FOR CONVERTING MODES BETWEEN A POST-WALL WAVEGUIDE AND A MICROSTRIP LINE USING AN EXCITATION PIN AND ANTI-PADS

(71) Applicant: FUJIKURA LTD., Tokyo (JP)

(72) Inventor: Yusuke Uemichi, Sakura (JP)

(73) Assignee: FUJIKURA LTD., Tokyo (JP)

( * ) Notice: Subject to any disclaimer, the term of this patent is extended or adjusted under 35 U.S.C. 154(b) by 249 days.

(21) Appl. No.: 17/431,457

(22) PCT Filed: Apr. 27, 2020

(86) PCT No.: PCT/JP2020/017940
§ 371 (c)(1),
(2) Date: Aug. 17, 2021

(87) PCT Pub. No.: WO2020/230608
PCT Pub. Date: Nov. 19, 2020

(65) Prior Publication Data

US 2022/0085479 A1 Mar. 17, 2022

(30) Foreign Application Priority Data

May 10, 2019 (JP) ..... 2019-090144

(51) Int. Cl.
*H01P 5/107* (2006.01)
*H01P 3/12* (2006.01)

(52) U.S. Cl.
CPC ..... *H01P 5/107* (2013.01); *H01P 3/121* (2013.01)

(58) Field of Classification Search
CPC ..... H01P 3/121; H01P 5/103; H01P 5/107; H05K 1/116

(Continued)

(56) References Cited

U.S. PATENT DOCUMENTS 7,019,600 B2 * 3/2006 Shono ..... H01P 5/107 333/33
8,552,815 B2 * 10/2013 Fujii et al. ..... H01P 3/121 333/248

(Continued)

FOREIGN PATENT DOCUMENTS

CN 104485500 A 4/2015
CN 104904061 A 9/2015

(Continued)

OTHER PUBLICATIONS

Notification of Transmittal of Translation of the International Preliminary Report on Patentability (Form PCT/IB/338) issued in counterpart International application No. PCT/JP2020/017940 dated Nov. 25, 2021 with Forms PCT/IB/373 and PCT/ISA/237. (5 pages).

(Continued)

*Primary Examiner* — Benny T Lee
(74) *Attorney, Agent, or Firm* — WHDA, LLP

(57) ABSTRACT

An aspect of the present invention is to reduce return loss in a mode converter. A mode converter (10) includes an excitation pin (through via TV) configured to carry out mutual conversion between a waveguide mode of a post-wall waveguide (PW) and a waveguide mode of a microstrip line (MS). The mode conductor includes a pair of wide walls (conductor layers 12 and 13), in which first and second anti-pads (anti-pads 12*c*, 13*c*) are formed, respectively. The first and second anti-pads each have an inner edge including the excitation pin and each have an outer size (diameter D12) that is more than 5 times and less than 6 times as large as the diameter (DT) of the excitation pin.

9 Claims, 3 Drawing Sheets

Figure 1:
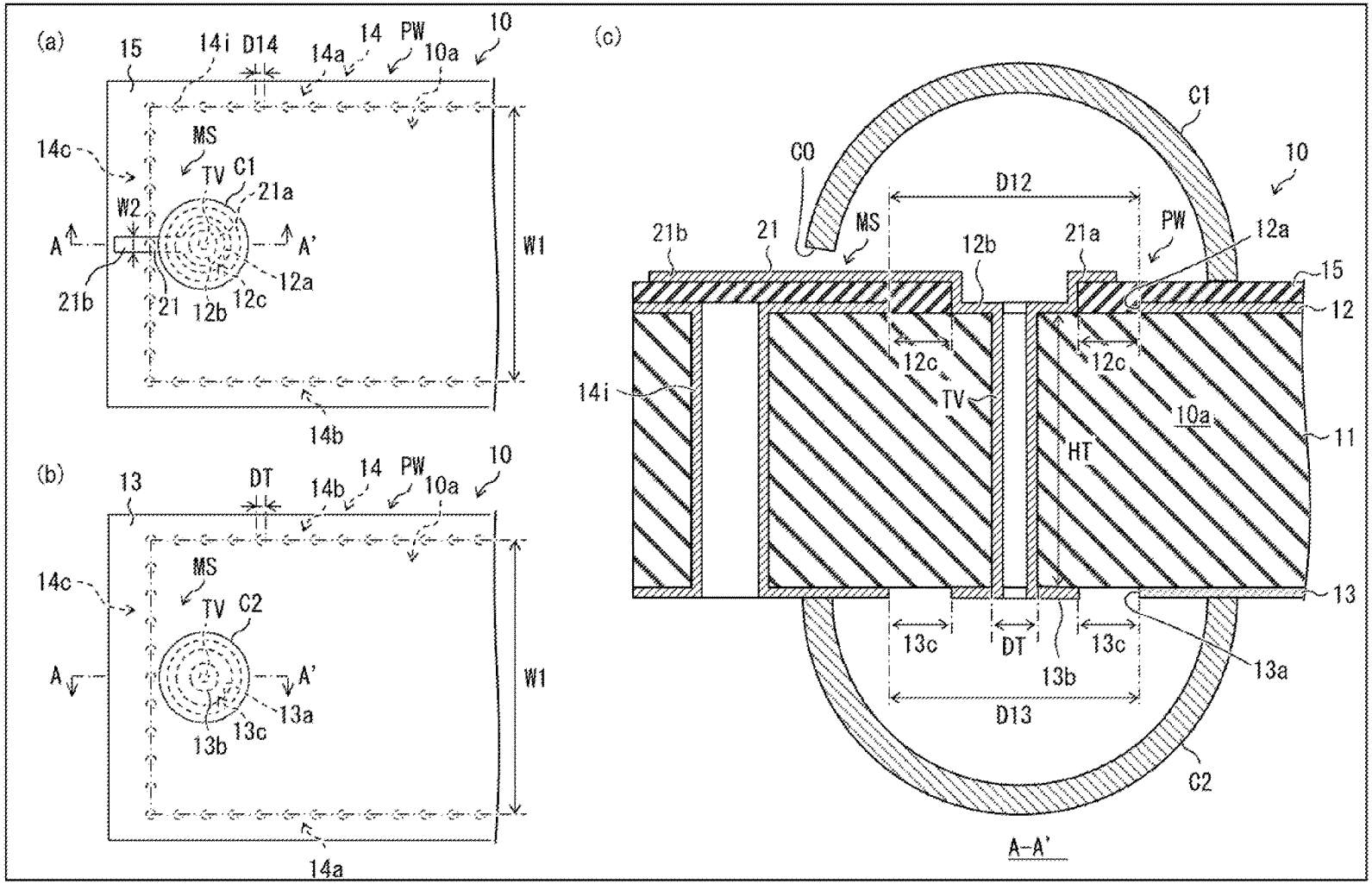

(58) Field of Classification Search
USPC ..... 333/26, 248
See application file for complete search history.

(56) References Cited

U.S. PATENT DOCUMENTS

| | | | | |
|---|---|---|---|---|
| 2012/0206219 | A1* | 8/2012 | Choi et al. ..... | H01P 5/107 333/230 |
| 2015/0295295 | A1 | 10/2015 | Uemichi | |

FOREIGN PATENT DOCUMENTS

| | | | |
|---|---|---|---|
| CN | 107293833 | A | 10/2017 |
| CN | 107946713 | A | 4/2018 |
| IN | 102509833 | A | 6/2012 |
| JP | H11-41010 | A | 2/1999 |
| JP | 2004-96206 | A | 3/2004 |
| JP | 2006-295670 | A | 10/2006 |
| JP | 5947917 | B2 | 7/2016 |
| WO | 2014/104336 | A1 | 7/2014 |

OTHER PUBLICATIONS

Xianjun, Lai, "Study of higher order mode microwave components based on substrste integrated waveguide", A thesis submitted to Xidian University in partial fulfillment of the requirements for the degree of Master in Electronics and Communications Engineering, 2017, pp. 1-69. (93 pages).

Office Action dated Dec. 24, 2021, issued in counterpart CN application No. 202080015005.5, with English translation. (11 pages).

International Search Report dated Jul. 21, 2020, issued in counterpart application No. PCT/JP2020/017940, w/English translation (4 pages).

Written Opinion dated Jul. 21, 2020, issued in counterpart application No. PCT/JP2020/017940 (4 pages).

* cited by examiner

MODE CONVERTER FOR CONVERTING MODES BETWEEN A POST-WALL WAVEGUIDE AND A MICROSTRIP LINE USING AN EXCITATION PIN AND ANTI-PADS

TECHNICAL FIELD

The present invention relates to a mode converter which carries out mutual conversion between a waveguide mode of a post-wall waveguide and a waveguide mode of a microstrip line.

BACKGROUND ART

Patent Literature 1 discloses mode converters each configured to carries out mutual conversion between a waveguide mode of a post-wall waveguide and a waveguide mode of a microstrip line.

Such a mode converter includes a post-wall waveguide, which includes a dielectric substrate, a pair of conductor layers formed on a pair of main surfaces of the substrate, respectively, and a post wall formed inside the substrate. The pair of conductor layers functions as a pair of wide walls which sandwich a waveguide region from two directions (e.g., upper and lower directions). The post wall functions as a pair of narrow walls and a pair of short walls which surround the waveguide region from four directions (e.g., front, rear, left, and right directions). The post wall is constituted by a plurality of through vias which are provided in a palisade arrangement inside the substrate, and which short-circuit the pair of conductor layers to each other. It should be noted that the dielectric constituting the substrate is made of glass in Patent Literature 1. The palisade arrangement means that the through vias are arranged so as to surround a planar area inside the substrate.

In order to carry out mutual conversion between the waveguide mode of the post-wall waveguide and the waveguide mode of the microstrip line, the above-described mode converter includes an excitation pin which is connected to one end of a signal line included in the microstrip line, and which is constituted by a through via penetrating through the post-wall waveguide. In other words, this excitation pin functions as a converter that carries out mutual conversion between the waveguide mode of the post-wall waveguide and the waveguide mode of the microstrip line.

In order to prevent the excitation pin and each of the pair of conductor layers from being short-circuited to each other, an anti-pad is formed by removing a ring-like portion of each of the conductor layers in a region including the excitation pin in plan view.

CITATION LIST

Patent Literature

[Patent Literature 1]
Japanese Patent No. 5947917 (published on 27 Dec., 2012)

SUMMARY OF THE INVENTION

Technical Problem

The inventors of the present invention have found that when the above configuration of the mode converter described in Patent Literature 1 is applied to a mode converter having a part of a millimeter-wave band as an operation band, return loss increases.

An aspect of the present invention is attained in view of the above problem. An object of an aspect of the present invention is to reduce return loss in a mode converter which carries out mutual conversion between a waveguide mode of a post-wall waveguide and a waveguide mode of a microstrip line.

Solution to the Problem

In order to solve the above problem, a mode converter in accordance with Aspect 1 of the present invention includes: a post-wall waveguide including a first wide wall and a second wide wall, which make a pair of wide walls; a microstrip line in which the first wide wall is a ground layer; and an excitation pin made of a through via which penetrates through the post-wall waveguide, the excitation pin being configured to carry out mutual conversion between a waveguide mode of the post-wall waveguide and a waveguide mode of the microstrip line, the first wide wall and the second wide wall having a first anti-pad and a second anti-pad, respectively, the first anti-pad and the second anti-pad each having a ring-like shape and each being formed so as to (i) have an inner edge including the excitation pin and (ii) have an outer size that is more than 5 times and less than 6 times as large as a diameter of the excitation pin, when seen in plan view.

Advantageous Effects of the Invention

An aspect of the present invention makes it possible to reduce return loss in a mode converter which carries out mutual conversion between a waveguide mode of a post-wall waveguide and a waveguide mode of a microstrip line.

BRIEF DESCRIPTION OF THE DRAWINGS (a) and (b) of FIG. 1 are plan views which illustrate a mode converter in accordance with an embodiment of the present invention, and which are obtained when a pair of conductor layers provided in the mode converter is seen in plan view, respectively. (c) of FIG. 1 is an enlarged cross-sectional view of the mode converter illustrated in (a) and (b) of FIG. 1.

Figure 2:
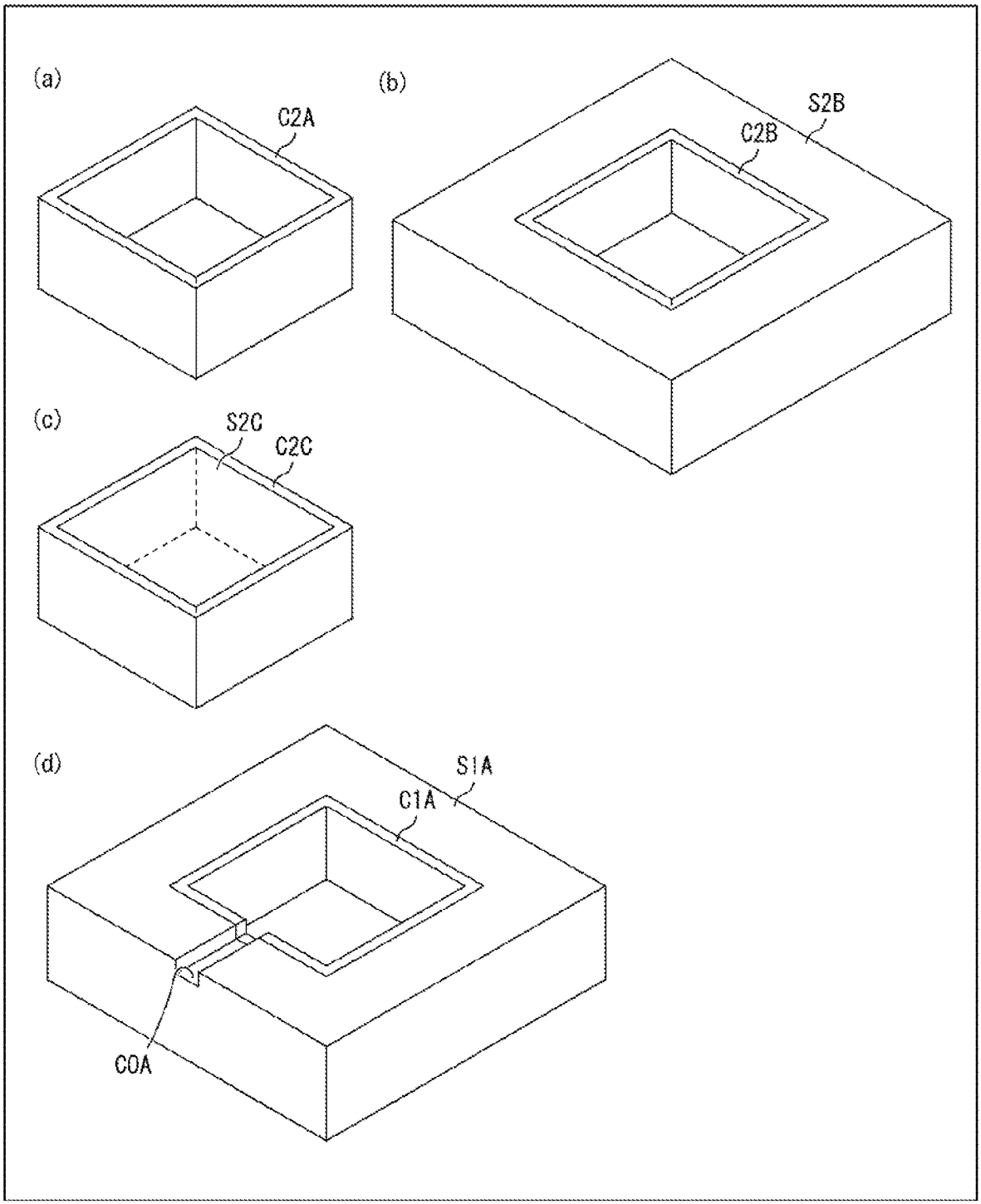

(a) to (c) of FIG. 2 are perspective views illustrating Variations 1 to 3 of a cap illustrated in (b) of FIG. 1, respectively. (d) of FIG. 2 is a perspective view of a variation of a cap illustrated in (a) of FIG. 1.

Figure 3:
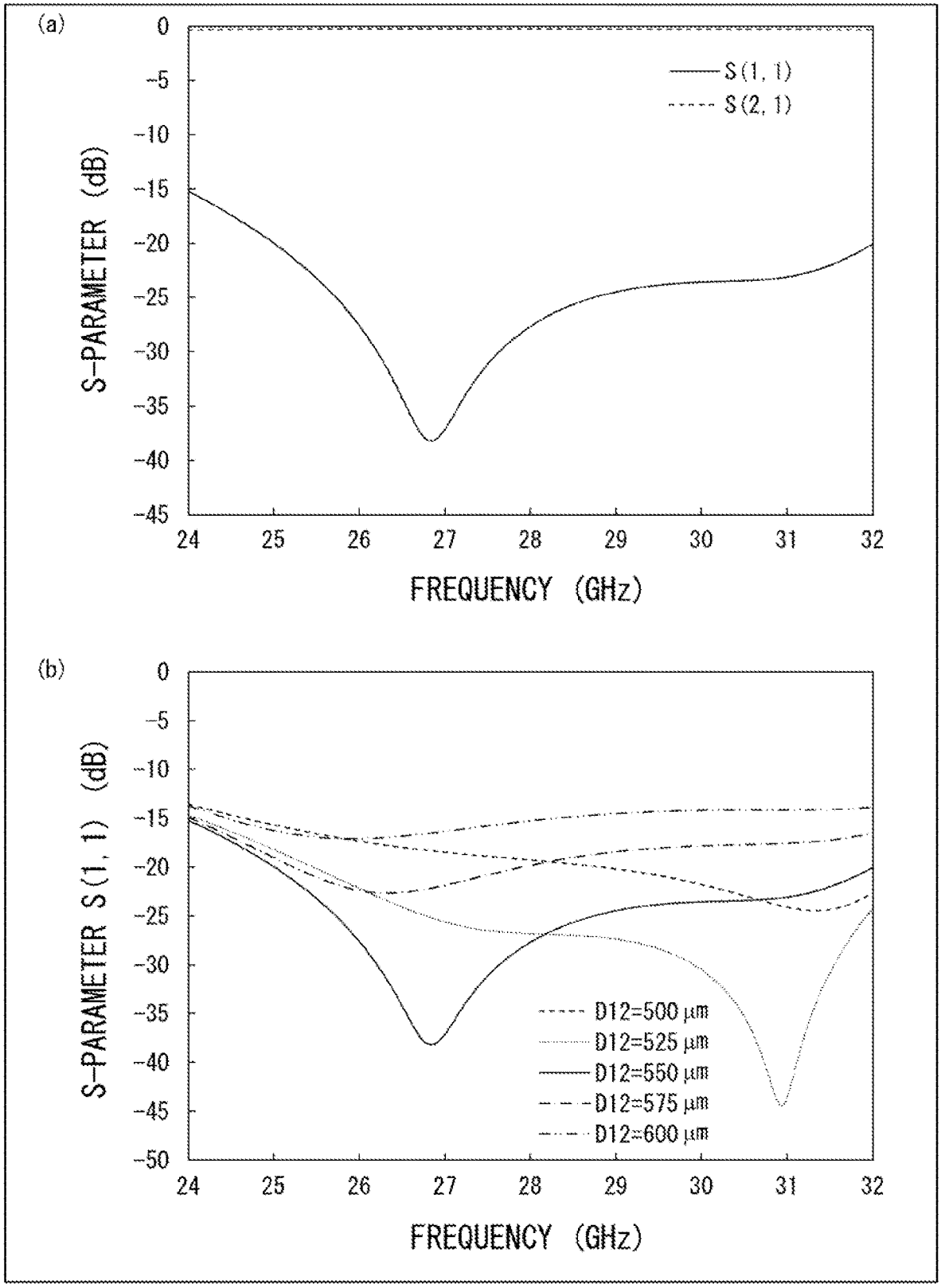

(a) of FIG. 3 is a graph showing reflection and transmission characteristics of a mode converter in accordance with Example 1 of the present invention. (b) of FIG. 3 is a graph showing respective reflection characteristics of Examples 1 to 3 of the present invention and Reference Examples 1 and 2.

DETAILED DESCRIPTION OF THE EMBODIMENTS

Embodiment 1

The following will discuss a mode converter in accordance with Embodiment 1 of the present invention, with reference to FIG. 1. (a) and (b) of FIG. 1 are plan views of a mode converter 10 in accordance with an embodiment of the present invention. The plan views are obtained when a pair of conductor layers 12 and 13 provided in the mode converter 10 are seen in plan view, respectively. (c) of FIG. 1 is an enlarged cross-sectional view obtained by enlarging the vicinity of a through via TV provided in the mode converter 10. (c) of FIG. 1 is also an enlarged cross-sectional view taken along line AA' illustrated in (a) and (b) of FIG. 1.

<Configuration of Mode Converter 10>

As illustrated in (a) to (c) of FIG. 1, the mode converter 10 includes a post-wall waveguide PW, a microstrip line MS, and a through via TV.

(Post-Wall Waveguide PW)

The post-wall waveguide PW includes a substrate 11, conductor layers 12 and 13, a post wall 14, a dielectric layer 15, and caps C1 and C2.

The substrate 11 is a plate-like member made of a dielectric. In the present embodiment, the substrate 11 is made of quartz. The dielectric constituting the substrate 11 is not limited to quartz. The dielectric can be appropriately selected in accordance with, for example, the central frequency of the mode converter 10.

Each of the conductor layer 12 and the conductor layer 13, which make a pair of conductor layers, is a layer member formed on each of a pair of main surfaces of the substrate 11 which face each other. The conductor layers 12 and 13 are each a layer member made of a conductor, and are made of copper in the present embodiment. The conductor constituting the conductor layers 12 and 13 are not limited to copper, and can be appropriately selected. The thicknesses of the conductor layers 12 and 13 can also be appropriately selected. The conductor layers 12 and 13 each can be a relatively thin layer member called a "conductor film," or can be a relatively thick layer member called a "conductor plate".

The post wall 14 is made of a plurality of through vias 14*i* provided in a palisade arrangement inside substrate 11. The palisade arrangement means that the through vias 141 to 14*n* are arranged so as to surround a planar area inside the substrate 11. The number of the plurality of through vias 14*i* is "n," that is, the plurality of through vias 14*i* includes 141 to 14*n*. Here, n is any integer of not less than 2. Hereinafter, the through vias 141 to 14*n* are each generically referred to as a through via 14*i*. Here, i is an integer of not less than 1 and not more than n. The post wall 14 includes a pair of narrow walls 14*a* and 14*b* which face each other, and a pair of short walls including one short wall 14*c* and the other short wall (not illustrated in (a) and (b) of FIG. 1) facing the short wall 14*c*. The through via 14*i* is made of a conductor having a hollow cylinder shape or a solid cylinder shape (hollow cylinder shape in the present embodiment). In other words, the vicinity of the central axis of the through via 14i may be hollow or solid.

The through via 14*i* extends from one main surface of the substrate 11 to the other main surface of the substrate 11, and short-circuits the conductor layer 12 and the conductor layer 13 to each other. Further, the diameter D14 of the through via 14*i* can be appropriately set in accordance with, for example, the width W1 of the post-wall waveguide PW (described later) and/or the complexity of the shape of the post-wall waveguide PW. In the present embodiment, the diameter D14 is set to 100 μm.

In the mode converter 10, the conductor layers 12 and 13 sandwich the substrate 11 from two directions (e.g., upper and lower directions). Moreover, the narrow walls 14*a* and 14*b* sandwich a partial region of the substrate 11 from two directions (e.g., left and right directions). Further, the short wall 14*c* and the other short wall sandwich the partial region of the substrate 11 from the other two directions (e.g., front and rear directions). The partial region of the substrate 11 are surrounded, by the conductor layers 12 and 13, the narrow walls 14*a* and 14*b*, the short wall 14*c*, and the other short wall, from the above six directions. This partial region functions as a waveguide region 10*a* of the mode converter 10. The waveguide region 10*a* is illustrated as a region surrounded by three sides indicated with a two-dot chain line, in (a) and (b) of FIG. 1. Meanwhile, the waveguide region 10*a* is a region on the right of the through via 14*i* in (c) of FIG. 1, and is also a region sandwiched between the conductor layers 12 and 13. Therefore, when the conductor layer 12 is seen in plan view, the region of the conductor layer 12 surrounded by the two-dot chain line functions as a first wide wall. Similarly, when the conductor layer 13 is seen in plan view, the region of the conductor layer 13 surrounded by the two-dot chain line functions as a second wide wall. The two-dot chain line shown in (a) of FIG. 1 is a straight line passing through respective centers of through vias 14*i*. The distance between the narrow wall 14*a* and the narrow wall 14*b* is hereinafter referred to as the width W1 of the post-wall waveguide.

The dielectric layer 15 is a layer member formed on the conductor layer 12. The dielectric layer 15 is a layer member made of a dielectric, and is made of a polyimide resin in the present embodiment. The dielectric constituting the dielectric layer 15 is not limited to a polyimide resin, and can be appropriately selected.

(Microstrip Line MS)

As illustrated in (a) and (c) of FIG. 1, the microstrip line MS is formed on the conductor layer 12 constituting the main surface of the post-wall waveguide PW. Further, the microstrip line MS is constituted by a signal line 21, a portion of the dielectric layer 15, and a portion of the conductor layer 12.

The signal line 21 is a strip-shaped conductor pattern having one end formed in a circular shape. This one end is referred to as an "end portion 21*a*." Except for the end portion 21*a*, the signal line 21 has a constant width W2. The diameter of the end portion 21*a* is configured to be larger than the width W2.

The signal line 21 has the end portion 21*a* including the through via TV (described later), and another end portion 21*b* which is the other end of the signal line 21 and which is provided outside the waveguide region 10*a*, when the post-wall waveguide PW is seen in plan view. The signal line 21 crosses the short wall 14*c*, when the post-wall waveguide PW is seen in plan view.

(Through Via TV)

As illustrated in (a) and (c) of FIG. 1, the through via TV is made of a conductor which has a tubular shape or a pillar shape (tubular shape in the present embodiment) and which is formed so as to penetrate through the substrate 11 of the post-wall waveguide PW. The through via TV is obtained by (i) forming a through hole penetrating through the substrate 11 at a predetermined position in the waveguide region 10*a* and (ii) forming a conductor film on a side surface of the through-hole (or filling the through-hole with a conductor). Therefore, the through via TV reaches, at one end thereof, the main surface of the substrate 11 on a side where the conductor layer 12 is provided, and reaches, at the other end thereof, the main surface of the substrate 11 on a side where the conductor layer 13 is provided.

Accordingly, the height HT of the through via TV is equal to the thickness of the substrate 11. The thickness of the substrate 11 and the height HT are not particularly limited. The thickness and the height HT can be appropriately selected in accordance with, for example, the central frequency of the mode converter 10. In the present embodiment, the thickness of the substrate 11 and the height HT are 860 μm.

In the present embodiment, the diameter DT as illustrated in (b) of FIG. 1 of the through via TV is equal to the diameter D14 of the through via 14*i* described above. In other words, in the present embodiment, DT=D14=100 μm. It is possible to produce the through via 14*i* and the through via TV together in one production process, by making respective sizes of the diameter DT and the diameter D14 equal to each other.

The conductor layer 12 has a portion removed. This portion is a circular ring-like portion which surrounds the through via TV, when the post-wall waveguide PW is seen in plan view. Consequently, when seen in plan view, (1) the conductor layer 12 is provided with an anti-pad 12*c* which is formed as an opening that surrounds the through via TV, and (2) the conductor layer 12 has a conductor pattern 12*b* which is a portion of the conductor layer 12 on an inner side of the anti-pad 12*c*. The anti-pad 12*c* is an example of a first anti-pad.

The conductor pattern 12*b* has an outer edge which is a circular conductor pattern. This conductor pattern is spaced apart from an opening 12*a* which is formed in the conductor layer 12.

The anti-pad 12*c* has an outer edge defined by the opening 12*a* of the conductor layer 12, and an inner edge defined by an outer edge of the conductor pattern 12*b*.

In the present embodiment, the anti-pad 12*c* is formed such that the through via TV, the inner edge of the anti-pad 12*c*, and the outer edge of the anti-pad 12*c* form concentric circles. Therefore, each of the opening 12*a* and the conductor pattern 12*b* of the conductor layer 12 is also concentric with the through via TV.

The diameter D12 of the outer edge of the anti-pad 12*c* (one example of an outer size of a ring-like anti-pad) is configured to fall within a range of more than 5 times and less than 6 times as large as the diameter DT described above. One preferred example of the diameter D12 is 550 μm.

When seen in plan view, the dielectric layer 15 has an opening formed in a region including the through via TV, and the end portion 21*a* of the above-described signal line 21 is formed so as to include the through via TV and the conductor pattern 12*b*. The through via TV is short-circuited to the signal line 21 via the conductor pattern 12*b* and via a conductor layer formed on a side wall of the opening of the dielectric layer 15. Further, in the present embodiment, the anti-pad 12*c* is covered with a resin material constituting the dielectric layer 15. It should be noted that the anti-pad 12*c* only needs to be partially covered with the resin material in at least a portion overlapping with the signal line 21 when seen in plan view, and that the anti-pad 12*c* may have a void portion which is covered with no resin material. This configuration makes it possible to support the signal line 21, without causing a short circuit of each of the signal line 21 and the conductor layer 12.

The conductor layer 13 has a portion removed. This portion is a circular ring-like portion which surrounds the through via TV when the post-wall waveguide PW is seen in plan view. Consequently, when seen in plan view, (1) the conductor layer 13 is provided with an anti-pad 13*c* which is formed as an opening that surrounds the through via TV, and (2) the conductor layer 13 has a conductor pattern 13*b* which is a portion of the conductor layer 13 on an inner side of the anti-pad 13*c*. In other words, the anti-pad 13*c* is a void part. This configuration may make it possible to further reduce return loss of the mode converter 10. The anti-pad 13*c* is an example of a second anti-pad.

The conductor pattern 13*b* has an outer edge which is a circular conductor pattern. This conductor pattern is spaced apart from an opening 13*a* which is formed in the conductor layer 13.

The anti-pad 13*c* has an outer edge defined by the opening 13*a* of the conductor layer 13, and an inner edge defined by an outer edge of the conductor pattern 13*b*.

In the present embodiment, the anti-pad 13*c* is formed such that the through via TV, the inner edge of the anti-pad 13*c*, and the outer edge of the anti-pad 13*c* form concentric circles. Therefore, each of the opening 13*a* and the conductor pattern 13*b* of the conductor layer 13 is also concentric with the through via TV. The through via TV is short-circuited to the conductor pattern 13*b*.

The diameter D13 of the outer edge of the anti-pad 13*c*, like the above-described diameter D12, is configured to fall within a range of more than 5 times and less than 6 times as large as the diameter DT described above. In the present embodiment, the diameter D13 is configured to be equal to the diameter D12. It should be noted that the diameter D13 may differ from the diameter D12, provided that the diameter D13 falls within a range of not less than 5 times and not more than 6 times as large as the diameter DT.

The through via TV configured as above is an aspect of an excitation pin which carries out mutual conversion between a waveguide mode of the post-wall waveguide PW and a waveguide mode of the microstrip line MS.

In the present embodiment, the anti-pad 12*c* and the anti-pad 13*c* have a circular ring-like shape. However, the anti-pad 12*c* and the anti-pad 13*c* only need to have a ring-like shape, and the shape of the outer edge and the inner edge of each of the anti-pad 12*c* and the anti-pad 13*c* are not limited to a circular shape. For example, the outer edge and the inner edge of each of the anti-pad 12*c* and the anti-pad 13*c* may have a polygonal shape. In this case, it is preferable that the outer edge and the inner edge have a regular polygonal shape. When the outer edge and the inner edge each have a regular polygonal shape, it is possible to increase a symmetric property of the anti-pad 12*c* and the anti-pad 13*c* which surround the through via TV. It should be noted that in a case where the outer edge has a polygonal shape, the anti-pad 12*c* and the anti-pad 13*c* each may have an outer size equal to the diameter of a circumscribed circle of the regular polygonal shape.

(Cap)

As illustrated in (c) of FIG. 1, each of both of the caps C1 and C2 are a lid-like member which is made of a conductor and which has an opening. The shape of the caps C1 and C2 are not limited, and can be appropriately selected. In the present embodiment, each of the caps C1 and C2 is a hemispherical cap which has a circular opening.

The cap C1 is provided on a surface of the conductor layer 12 such that the opening of the cap C1 surrounds the outer edge of the anti-pad 12*c*. It should be noted that the signal line 21 is formed on the surface of conductor layer 12. In order to avoid short-circuiting of the cap C1 to the signal line 21, a portion of the cap C1 is provided with a notch CO for keeping the cap Cl away from the signal line 21. Since the notch CO is formed at the portion of the cap C1, the cap C1 is insulated from the signal line 21. The cap C1 is an example of a second cap.

The cap C1 is preferably fixed to the surface of the conductor layer 12 with use of a conductive fixing means. Examples of the conductive fixing means include solder and conductive adhesives. This configuration makes it possible to easily short-circuit the cap C1 to the conductor layer 12.

The cap C2 is provided on a surface of the conductor layer 13 such that the opening of the cap C2 surrounds the outer edge of the anti-pad 13*c*. The cap C2 is preferably fixed to the surface of the conductor layer 13 with use of a conductive fixing means. Examples of the conductive fixing means include solder and conductive adhesives. This configuration makes it possible to easily short-circuit the cap C2 to the conductor layer 13. The cap C2 is an example of a first cap.

In the present embodiment, the mode converter 10 includes the caps C1 and C2. However, the mode converter 10 only needs to include at least one of the cap C1 and the cap C2. In other words, in the mode converter 10, the cap C1 or the cap C2 can be omitted. However, it is preferable that the mode converter 10 include the caps C1 and C2 from the viewpoint of (i) reducing electromagnetic waves which may leak out of the post-wall waveguide PW and (ii) suppressing an influence which may occur on a conversion characteristic of the mode converter 10 due to a change in an external environment.

(Variations of Cap)

The following will discuss Variations 1 to 3 of the cap C2 and a variation of the cap C1, with reference to FIG. 2. (a) of FIG. 2 is a perspective view of a cap C2A, which is Variation 1 of the cap C2. (b) of FIG. 2 is a perspective view of a cap C2B, which is Variation 2 of the cap C2. (c) of FIG. 2 is a perspective view of a cap C2C, which is Variation 3 of the cap C2. (d) of FIG. 2 is a perspective view of a cap C1A, which is a variation of the cap C1.

The cap C2A illustrated in (a) of FIG. 2 is obtained by changing the shape of the hemispherical shape of the cap C2 to a square-box shape (or a tub shape). The square-box shape (or the tub shape) is a shape having a planar bottom surface and side walls which surround outer edges of the bottom surface. In Variation 1, although the shape of the bottom surface is a square shape, the shape is not limited to the square shape.

The cap C2B illustrated in (b) of FIG. 2, like the cap C2A illustrated in (a) of FIG. 2, has a square-box shape (or a tub shape). Additionally, the cap C2B is supported by a block-like support member S2B. Specifically, the support member S2B, which is made of a dielectric (e.g., made of quartz), has a rectangular parallelepiped recessed portion formed on a main surface of the support member S2B on a side of the conductor layer 13 of the support member S2B. The cap C2B supported by the support member S2B can be obtained by forming a conductor film on inner walls of this recessed portion.

The support member S2B is provided on the surface of the conductor layer 13 so that the cap C2B covers the anti-pad 13*c*. This causes an opening of the cap C2B to surround the outer edge of the anti-pad 13*c* as in an aspect illustrated in (c) of FIG. 1.

It should be noted that in (b) of FIG. 2, no conductor film is formed on the main surface of the support member S2B on the side of the conductor layer 13. However, it is possible to have a conductor film formed on the main surface of the support member S2B on the side of the conductor layer 13 like the cap C2B has a conductor film. This configuration increases an area of the conductor film in contact with the conductor layer 13, and therefore, makes it possible to reliably short-circuit the cap C2B to the conductor layer 13.

Further, in Variation 2, the support member S2B is made of a dielectric, and the cap C2B is constituted by forming the conductor film on the inner walls of the recessed portion. However, in a case where the support member S2B is made of metal (for example, aluminum alloy or copper), it is possible to cause inner walls of a recessed portion to be the cap C2B by forming the recessed portion on the main surface of the support member S2B on the side of the conductor layer 13.

Further, in Variation 2, the support member S2B is a block-like member, but may be a plate-like member such as a substrate.

The cap C2C illustrated in (c) of FIG. 2, like the caps C2A and C2B, has a square-box shape (or a tub shape), and is supported by a support member S2C. However, the cap C2C differs from the cap C2B in how the cap C2C is supported by the support member S2C.

Specifically, the cap C2C supported by the support member S2C can be obtained by forming a conductor film on side surfaces and a main surface of the support member S2C which is a block-like member made of a dielectric (for example, quartz). The main surface is farther from the conductor layer 13 than from the other surfaces of the support member S2C.

The support member S2C is provided on the surface of the conductor layer 13 so that the cap C2C covers the anti-pad 13*c*. This causes an opening of the cap C2C to surround the outer edge of the anti-pad 13*c* as in the aspect illustrated in (c) of FIG. 1.

The cap C1A illustrated in (d) of FIG. 2, like the cap C2B illustrated in (b) of FIG. 2, has a square-box shape (or a tub shape). Further, the cap C1A is supported by a support member S1A which is configured in a similar manner to the support member S2B as illustrated in (b) of FIG. 2.

The cap CIA and the support member S1A are different from the cap C2B and the support member S2B, in that a linear groove COA is formed on a main surface on a side of the conductor layer 12. The linear groove COA extends from a recessed portion to the outside of the support member S1A. The width of the groove COA is larger than the width W2 of the signal line 21. Further, the depth of the groove COA is larger than the thickness of the signal line 21. Configuring the groove COA as described above can make it possible to prevent a short circuit which may be caused by a contact between the signal line 21 and the cap C1A, even in a case where the support member S1A is provided on the surface of the conductor layer 12 such that the cap C1A covers the anti-pad 12*c*. In other words, the cap C1A is insulated from the signal line 21.

It should be noted that the present variation omits descriptions on the cap C1A and the support member S1A except for a description on the configuration of the groove COA.

Group of Examples

The following will discuss characteristics of a group of Examples of the mode converter 10 described in Embodiment 1, with reference to FIG. 3. (a) of FIG. 3 is a graph showing reflection and transmission characteristics of a mode converter 10 of Example 1. (b) of FIG. 3 is a graph showing reflection characteristics of mode converters 10 of Examples 1 to 3 and Reference Examples 1 and 2.

The above Example 1 is based on the mode converter 10 illustrated in FIG. 1. The above Example 1 was obtained by omitting the cap C1 and using, in place of the cap C2, the cap C2B and the support member S2B which are illustrated in (b) of FIG. 2.

Example 1 was designed so as to have, as an operation band, the 28GHz band which is a part of a millimeter-wave band. Specifically, Example 1 was arranged such that: the thickness HT of the substrate 11 was 860 μm; the width W1 of the post-wall waveguide PW was 4 mm; the width W2 of the signal line 21 was 200 μm, the diameter DT of the through via TV and the diameter D14 of the through via 14*i* were each 100 μm; and the diameter D12 of the anti-pad 12*c* and the diameter of the anti-pad 13*c* were each 550 μm.

In (a) and (b) of FIG. 3, the horizontal axis indicates a frequency in GHz and a vertical axis indicates S-parameter in dB. Simulations were carried out for frequency dependence of S-parameter S(1, 1) (hereinafter, referred to as "reflection characteristic") of the above Example 1 and frequency dependence of S-parameter S(2, 1) (hereinafter, referred to as "transmission characteristic") of the above Example 1. (a) of FIG. 3 shows results of the simulations. In (a) of FIG. 3, the solid line indicates S-parameter S(1, 1), and the dotted line indicates S-parameter S(2, 1).

The operation band of a mode converter can be appropriately set in accordance with an application or the like of the mode converter. In the above Example 1, the operation band is a band in which the S-parameter S(1, 1) is lower than −15 dB.

With reference to (a) of FIG. 3, the above Example 1 was found to have a wide operation band of not less than 24 GHz and not more than 32 GHz.

In order to confirm a relation with the diameter of an anti-pad, the diameter D12 of the anti-pad 12*c* and the diameter of the anti-pad 13*c* were changed in increments of 50 μm within a range of not less than 500 μm and not more than 600 μm ((b) of FIG. 3).

With reference to (b) of FIG. 3, it was found that in cases where the diameter D12 and the diameter of the anti-pad 13*c* of a mode converter 10 were 500 μm or 600 μm, the S-parameter S(1, 1) was higher than −15 dB in a portion of the band of not less than 24 GHz and not more than 32 GHz. In light of the above, such mode converters 10 are referred to as Reference Examples 1 and 2, respectively. On the other hand, it was found that in cases where the diameter D12 and the diameter of the anti-pad 13*c* of a mode converter 10 were any of 525 μm, 550 μm, and 575 μm, the mode converter 10 had a wide operation band of not less than 24 GHz and not more than 32 GHz as in the above Example 1.

Aspects of the present invention can also be expressed as follows:

A mode converter in accordance with Aspect 1 of the present invention includes: a post-wall waveguide including a first wide wall and a second wide wall, which make a pair of wide walls; a microstrip line in which the first wide wall is a ground layer; and an excitation pin made of a through via which penetrates through the post-wall waveguide, the excitation pin being configured to carry out mutual conversion between a waveguide mode of the post-wall waveguide and a waveguide mode of the microstrip line, the first wide wall and the second wide wall having a first anti-pad and a second anti-pad, respectively, the first anti-pad and the second anti-pad each having a ring-like shape and each being formed so as to (i) have an inner edge including the excitation pin and (ii) have an outer size that is more than 5 times and less than 6 times as large as a diameter of the excitation pin, when seen in plan view.

According to the above Aspect 1, the mode converter is configured such that the first anti-pad and the second anti-pad each have an outer size that is more than 5 times and less than 6 times as large as the diameter of the excitation pin. This allows return loss to be reduced in the mode converter which has, as an operation band, a part of a millimeter-wave band and which carries out mutual conversion between the waveguide mode of the post-wall waveguide and the waveguide mode of the microstrip line.

A mode converter in accordance with Aspect 2 of the present invention is configured to further include, in the mode converter of Aspect 1 described above, a cap made of a conductor provided on a surface of the second wide wall, the cap having an opening which surrounds an outer edge of the second anti-pad.

A second anti-pad functions as a coupling window through which the interior and the exterior of a post-wall waveguide are electromagnetically coupled to each other. Therefore, part of a waveguide mode of the post-wall waveguide easily leaks out of the post-wall waveguide via the second anti-pad. Further, conversion characteristics of a mode converter are easily influenced by a change in an external environment surrounding the vicinity of the second anti-pad.

According to the above Aspect 2, the opening of the cap made of a conductor surrounds the outer edge of the second anti-pad, in other words, the cap made of a conductor covers the second anti-pad. This makes it possible to (i) reduce electromagnetic waves which may leak out of the post-wall waveguide and also (ii) suppress an influence which may occur on a conversion characteristic of the mode converter due to a change in an external environment.

A mode converter in accordance with Aspect 3 of the present invention is configured to further include, in the mode converter of Aspect 2 described above, a support member being a plate-like or block-like support member, which is provided on the surface of the second wide wall so as to cover the second anti-pad, the support member having a recessed portion formed on a main surface of the support member on a side where the second wide wall is present, the recessed portion having an outer edge which surrounds the second anti-pad, the cap being made of a conductor constituting at least a surface of the recessed portion of the support member.

Moreover, a mode converter in accordance with Aspect 4 of the present invention is configured to further include, in the mode converter of Aspect 2 described above, a support member being a plate-like or block-like support member made of a dielectric, which is provided on the surface of the second wide wall so as to cover the second anti-pad, the cap being made of a conductor which covers side surfaces and a main surface that is farther from the second wide wall, among surfaces of the support member.

The above Aspects 3 and 4 make it possible to easily provide the cap and the support member on the surface of the second wide wall.

A mode converter in accordance with Aspect 5 of the present invention is configured to further include, in the mode converter of any one of Aspects 2 to 4 described above, a second cap when the cap is a first cap, the second cap being made of a conductor which is provided on a surface of the first wide wall, having an opening which surrounds an outer edge of the first anti-pad, and being insulated from a signal line included in the microstrip line.

A first anti-pad, like the second anti-pad, functions as a coupling window through which the interior and the exterior of a post-wall waveguide are electromagnetically coupled to each other.

The above Aspect 5 makes it possible to (i) reduce electromagnetic waves which may leak out of the post-wall waveguide and also (ii) suppress an influence which may occur on a conversion characteristic of the mode converter due to a change in an external environment, as in the case of including the first cap.

A mode converter in accordance with Aspect 6 of the present invention is configured to further include, in the mode converter of Aspect 5 described above, a support member being a plate-like or block-like support member, which is provided on the surface of the first wide wall so as to cover the first anti-pad, the support member having a recessed portion which is formed on a main surface of the support member on a side where the first wide wall is present, the recessed portion having an outer edge which surrounds the first anti-pad, the second cap being made of a conductor constituting at least a surface of the recessed portion of the support member.

Moreover, a mode converter in accordance with Aspect 7 of the present invention is configured to further include, in the mode converter of Aspect 5 described above, a support member being a plate-like or block-like support member made of a dielectric, which is provided on the surface of the first wide wall so as to cover the first anti-pad, the second cap being made of a conductor which covers side surfaces and a main surface that is farther from the first wide wall, among surfaces of the support member.

The above Aspects 6 and 7 make it possible to easily provide the second cap and the support member on the surface of the first wide wall.

A mode converter in accordance with Aspect 8 of the present invention is configured such that in the mode converter of any one of Aspects 1 to 7 described above, the first anti-pad is at least partially covered with a resin material.

The above Aspect 8 makes it possible to support the signal line, without causing a short circuit of each of the signal line and the ground layer which form the microstrip line.

A mode converter in accordance with Aspect 9 of the present invention is configured such that in the mode converter of any one of the above Aspects 1 to 8 described above, the second anti-pad is a void part.

The above Aspect 9 makes it possible to further reduce return loss.

[Additional Remarks]

The present invention is not limited to the above embodiments, but can be altered by a person skilled in the art within the scope of the claims. The present invention also encompasses, in its technical scope, any embodiment derived by combining technical means disclosed in differing embodiments.

REFERENCE SIGNS LIST

10 mode converter
PW post-wall waveguide
11 substrate
12, 13 conductor layer (first wide wall, second wide wall)
12*c*, 13*c* anti-pad (first anti-pad, second anti-pad)
14 post wall
14*a*, 14*b* narrow wall
14*i* through via
15 dielectric layer
MS microstrip line
21 signal line
TV through via (excitation pin)
C1, C1A cap (second cap)
S1A support member (support member of second cap)
C2, C2A, C2B, C2C cap (first cap)
S2B, S2C support member (support member of first cap)

The invention claimed is:

1. A mode converter comprising:

a post-wall waveguide including a first wide wall and a second wide wall, which make a pair of wide walls;

a microstrip line in which the first wide wall is a ground layer; and an excitation pin made of a through via which penetrates through the post-wall waveguide, the excitation pin being configured to carry out mutual conversion between a waveguide mode of the post-wall waveguide and a waveguide mode of the microstrip line, the first wide wall and the second wide wall having a first anti-pad and a second anti-pad, respectively, the first anti-pad and the second anti-pad each having a ring-like shape and each of the first and second anti-pads being formed so as to (i) have an inner edge including the excitation pin and (ii) have an outer size that is more than 5 times and less than 6 times as large as a diameter of the excitation pin, when seen in plan view.

2. The mode converter as set forth in claim 1, further comprising a cap made of a conductor provided on a surface of the second wide wall, the cap having an opening which surrounds an outer edge of the second anti-pad.

3. The mode converter as set forth in claim 2, further comprising a support member being a plate-like or block-like support member, which is provided on the surface of the second wide wall so as to cover the second anti-pad, the support member having a recessed portion formed on a main surface of the support member on a side where the second wide wall is present, the recessed portion having an outer edge which surrounds the second anti-pad, the cap including a portion on a surface of the recessed portion of the support member.

4. The mode converter as set forth in claim 2, further comprising a support member being a plate-like or block-like support member made of a dielectric, which is provided on the surface of the second wide wall so as to cover the second anti-pad, the support member including side surfaces and a main surface, the main surface being farther from the second wide wall than from the side surfaces, the cap covering the side surfaces and the main surface.

5. The mode converter as set forth in claim 2, further comprising a second cap when the cap is a first cap, the second cap being made of a conductor which is provided on a surface of the first wide wall, having an opening which surrounds an outer edge of the first anti-pad, and being insulated from a signal line constituting the microstrip line.

6. The mode converter as set forth in claim 5, further comprising a support member being a plate-like or block-like support member, which is provided on the surface of the first wide wall so as to cover the first anti-pad, the support member having a recessed portion which is formed on a main surface of the support member on a side where the first wide wall is present, the recessed portion having an outer edge which surrounds the first anti-pad, the second cap including a portion on a surface of the recessed portion of the support member.

7. The mode converter as set forth in claim 5, further comprising a support member being a plate-like or block-like support member made of a dielectric, which is provided on the surface of the first wide wall so as to cover the first anti-pad, the support member including side surfaces and a main surface, the main surface being farther from the first wide wall than from the side surfaces, the second cap covering the side surfaces and the main surface.

8. The mode converter as set forth in claim 1, wherein the first anti-pad is at least partially covered with a resin material.

9. The mode converter as set forth in claim 1, wherein the second anti-pad is a void part.

* * * * *